United States Patent [19]

Fitzgerald et al.

[11] 4,249,155

[45] Feb. 3, 1981

[54] HEATING AND COOLING THERMOSTAT WITH LIMITING ACTION SELECTED BY THE CHANGEOVER SWITCHING APPARATUS

[75] Inventors: Richard E. Fitzgerald, Minneapolis; Dennis R. Grabowski, Dakota, both of Minn.

[73] Assignee: Honeywell Inc., Minneapolis, Minn.

[21] Appl. No.: 70,756

[22] Filed: Aug. 30, 1979

[51] Int. Cl.[3] ..... H01H 37/12

[52] U.S. Cl. ..... 337/360; 165/26; 236/1 C

[58] Field of Search ..... 337/340, 360, 323, 392, 337/303; 236/1 C, 68 B; 165/26, 27

[56] References Cited

U.S. PATENT DOCUMENTS

| | | | |
|---|---|---|---|
| Re. 28,676 | 1/1976 | Edelman | 236/1 C |
| 1,638,582 | 8/1927 | Houch | 337/303 |
| 1,783,309 | 12/1930 | Rutenber | 337/351 |
| 2,575,005 | 11/1951 | Cosgrove | 337/360 |
| 2,729,719 | 1/1956 | Kronmiller | 337/352 |
| 2,978,924 | 4/1961 | Georges | 74/526 |
| 3,807,254 | 4/1974 | Brakebill | 337/360 |
| 3,999,158 | 12/1976 | Rae | 337/360 |
| 4,078,601 | 3/1978 | Kolbow | 165/26 |
| 4,090,165 | 5/1978 | Rae | 337/360 |
| 4,177,860 | 12/1979 | Johnson et al. | 337/360 |

*Primary Examiner*—William H. Beha, Jr.
*Attorney, Agent, or Firm*—Clyde C. Blinn

[57] ABSTRACT

A thermostat adapted for controlling heating and cooling apparatuses has a temperature control point adjustment means connected to a temperature responsive switch means for adjusting the control point thereof. A changeover switch means is connected to the temperature responsive switch means for selectively connecting either heating or cooling apparatus to the temperature responsive switch means. A temperature control point limit means is connected to the temperature control point adjustment means so that upon selecting by means of the changeover switch means either a heating or a cooling operation, the temperature control point limit means limits the movement of the temperature control point adjustment means to a first range of movement when heating is selected and a second range of movement when cooling is selected.

7 Claims, 7 Drawing Figures

HEATING AND COOLING THERMOSTAT WITH LIMITING ACTION SELECTED BY THE CHANGEOVER SWITCHING APPARATUS

BACKGROUND AND SUMMARY OF THE INVENTION

For many years for limiting the temperature and for energy conservation, thermostats have had means to limit the adjustment of a temperature control point adjusting means or lever to some selected value for both heating and cooling operations. In thermostats making use of separate adjusting levers for heating and/or cooling, the limiting action is quite simple in that a stop is used for the heating lever and a stop is used for a cooling lever and these stops can be independently adjusted.

In thermostats such as the Walter E. Edelman et al U.S. Pat. No. Re. 28,676, issued Jan. 13, 1976, having a single temperature control point adjustment means for both the heating and cooling operation, stops for both heating and cooling operation are difficult to use in that there are two ranges of operation for the heating and/or cooling apparatus. One particular method of accomplishing the limiting action is shown in the Donald P. Kolbow U.S. Pat. No. 4,078,601, issued Mar. 14, 1978. The thermostat has a single temperature control point adjustment means with separate ranges for the heating and cooling operation and a changeover switch which provides an off operation between the two ranges. With such a thermostat, a heating operation can be accomplished to limit the maximum heating temperture and a cooling operation can be selected to limit the minimum cooling temperature. Such a thermostat has certain disadvantages, one of which is that the thermostat temperature control point adjustment means can be inadvertently placed in the off position and the homeowner would not be aware that the system was completely off.

The present invention is concerned with a thermostat having a changeover switch means which selects the limiting action of the thermostat depending upon whether the thermostat is in the heating or cooling operation so that during the heating operation a first range of operation is selected and during the cooling operation a second range of operation is selected. With such an invention, the ranges can be set to provide for a maximum temperature during the heating operation of 72° and a minimum temperature of 78° for the cooling operation by the changeover operator. The temperature selection is made by the single temperature control point adjusting means or knob.

DESCRIPTION OF THE PREFERRED EMBODIMENT

Figure 1:
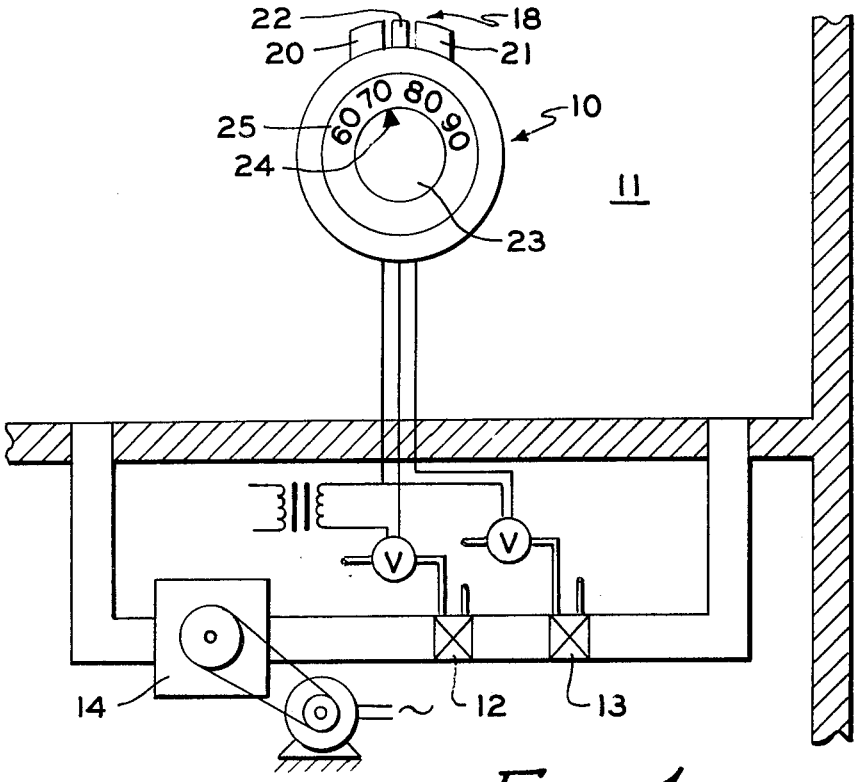
FIG. 1 is a schematic representation of the system making use of the thermostat of the present invention.

Referring to FIG. 1, a thermostat 10 controls the temperature in a space which is conditioned by heating apparatus 12 and cooling apparatus 13 of a conventional type. Air is circulated by means of a fan 14 through heating and cooling heat exchangers 12 and 13 to maintain the temperature in space 11 as selected by thermostat 10.

Thermostat 10 has a changeover operation means 18 having a cooling button 20, a heating button 21 and a changeover switch lever 22 whereby upon the operation of lever 22 in one direction or the other, the electrical system is changed over to either heating or cooling operation to maintain the temperture as selected by a single temperature control point adjusting knob 23 when positioned to provide the selected temperature by index or pointer 24 on the scale 25.

Figure 2:
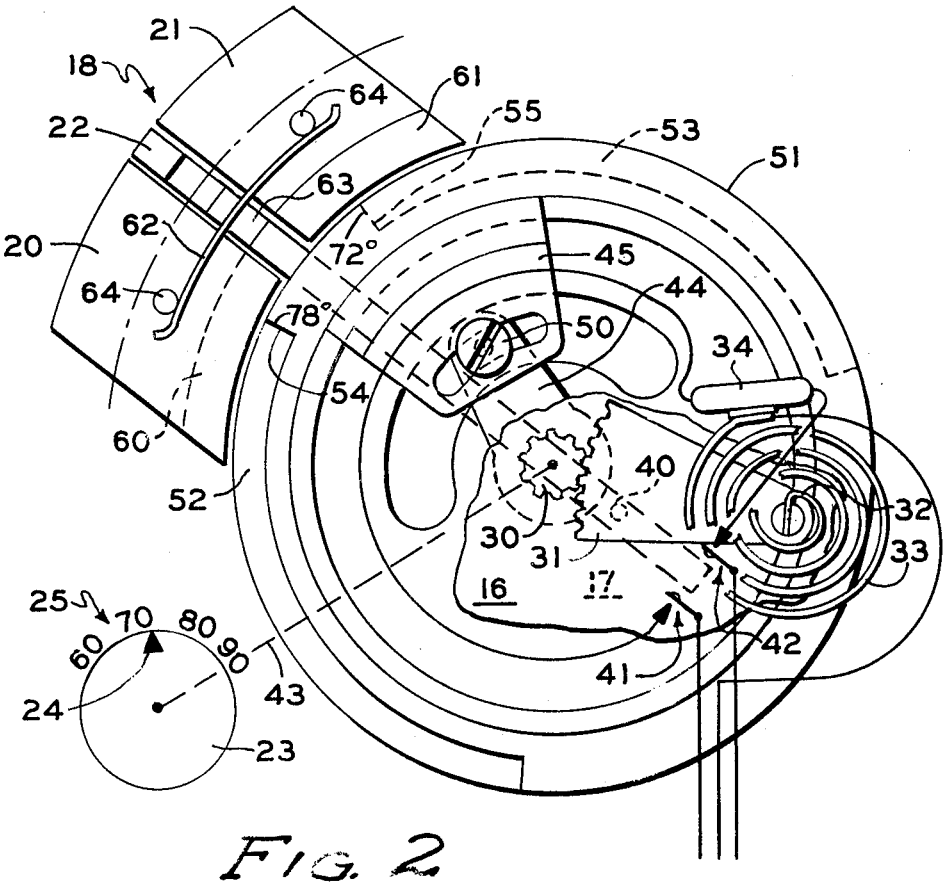
FIG. 2 is a cross-sectional view of the thermostat showing the limiting action and the changeover switch means.

The details of the thermostat are shown in FIG. 2 to have control point adjusting knob 23 connected by shaft 43 to a gear 30 and to a gear sector 31 mounted on a base 16. Gear sector 31 positions a fixed end 32 of a bimetal 33 supporting a switch 34. By the adjustment of knob 23 to position pointer 24 on scale 25, the temperature control point of the bimetal or temperature responsive meas 33 is selected similar to the control device of the Carl G. Kronmiller U.S. Pat. No. 2,729,719, issued June 3, 1956.

Changeover switch lever 22 is pivoted on a subbase 17 at a pivot 40 to operate either a heating switch 41 or a cooling switch 42 which connects double ended mercury switch 34 to the system for controlling either heating or cooling apparatus as described in the mentioned Walter E. Edelman et al patent.

Shaft 43 is also connected to a member 44 which is adjustably connected to member 45 by the screw 50 for calibration of the limit stops. Member 45 is part of a limit stop member 51 which is in the form of a ring lying under base member 16 which supports the thermostat mechanism above subbase 17. The ring member 51 has a first slot 52 providing a cooling range limiting action and a second slot 53 providing a heating range limiting operation. Slot 52 has a cooling limiting stop 54 which might be limited to a minimum of 78°, depending upon the adjustment of members 44 and 45 and set by screw 50, and slot 53 has a heating limiting stop 55 which might be limited to a maximum of 72°.

Limiting buttons or pin members 20 and 21 of changeover operating means 16 have lower portions 60 and 61, respectively, which are adapted to be received by slots 52 and 53, respectively, depending upon position of control point adjusting knob 23 and ring 51. Buttons 20 and 21 are biased outward by spring 62 which is attached to base 16 at its intermediate portion to apply an upward force on each of pins 64. Slots 52 and 53 are staggered so that lower portion 60 of button 20 can only be received by slot 52 and lower portion 61 of button 21 can only be received by slot 53.

Figure 3:
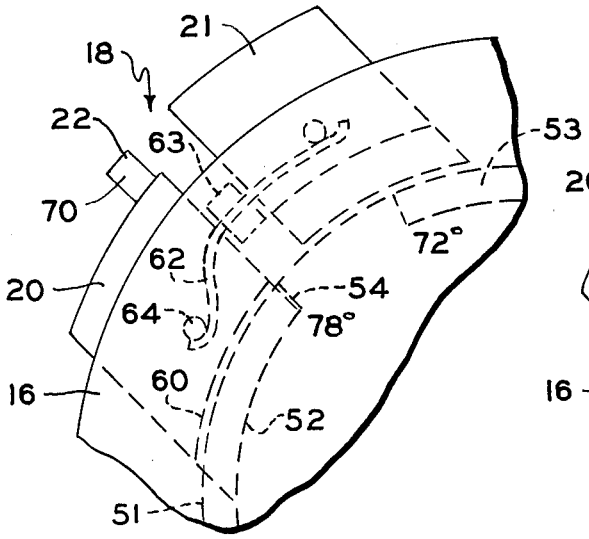
FIG. 3 is a portion of the thermostat of FIG. 2 showing the heating/cooling changeover switch button in the cooling operative position.
Figure 4:
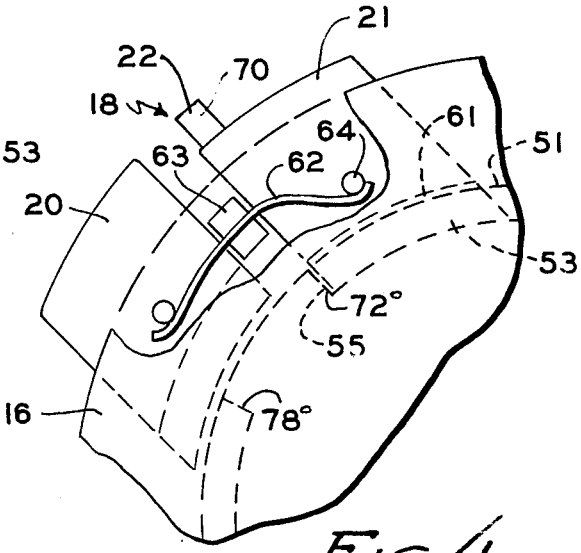
FIG. 4 is another partial showing of the thermostat with the system switched in the heating position.

Upon the adjustment of control point temperature adjusting knob 23 to a position above 78° so that member 51 is in a position as shown in FIG. 3, button 20 is pushed downward and lever 22 moved counterclockwise so that an outward portion 70 of lever 22 extends over the button to hold button 20 down. The lower portion 60 of button 20 is then received by slot 52 and the control point of the thermostat can be adjusted in a range having a minimum temperature of 78° as determined by stop 54. By the same type of operation, the heating action is accomplished as shown in FIG. 4 when the control point adjusting knob was turned below 72° and member 51 is in the position shown for receiving lower portion 61 of heating button 21. In such an operation, the maximum temperature for heating is limited by the stop 55 or 72°.

Figure 5:
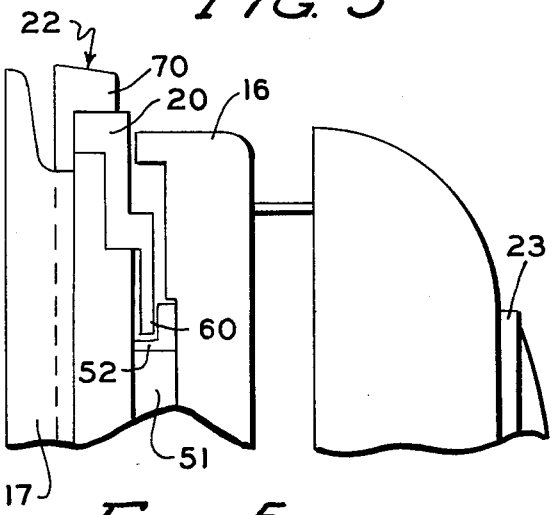
FIG. 5 is a side view of the thermostat shown in FIG. 2.
Figure 7:
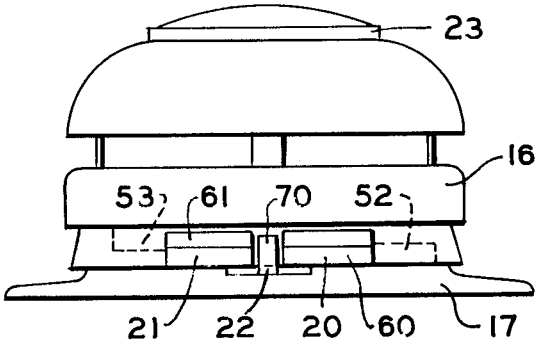
FIG. 7 is a side view of the thermostat shown with the changeover switch in the "off" position.

The outward portion 70 of lever 22 which is positioned over cooling button 20 as shown in FIG. 3, is shown in the side view of FIG. 5 wherein lower portion 60 of button 20 is received by slot 52. FIG. 7 shows the thermostat in the off position.

OPERATION OF THE PREFERRED EMBODIMENT

As shown in FIG. 1, the changeover switch lever 22 is in the off position and buttons 20 and 21 are biased outwardly. If the cooling operation is desired, the thermostat control point must be moved above the minimum temperature of 78° F. which can be maintained. Upon rotating the control point adjustment knob 23 clockwise until the slot 52, as shown in FIG. 2, lies below button 20 to be received by projection 60, button 20 can be pushed downward and changeover switch lever 22 can be moved to the left engaging cooling switch 42 so that the overhanging projection 70 can hold the button in a downward position. In that position, the temperature control point of the thermostat can be adjusted to maintain the selected temperature as long as a control point is adjusted above 78°. At 78°, stop 54 is engaged by the lower portion 60 of button 20 to prevent movement of the control point adjustment knob counterclockwise to a lower cooling temperature.

By the same token, the limiting action for the heating operation is obtained by placing the control point of the thermostat by knob 23 below 72° so that slot 53 is aligned with the lower portion 61 of button 21 as shown in FIG. 4. In such a position, button 21 can be moved downward and the changeover switch lever 22 can be moved to the right to hold the button down and provide the changeover operation to heating by switch 41.

The calibration of the limiting stops is obtained by the adjustment of members 44 and 45 with the set screw 50, however, the particular range of the limiting stop is set by the space or distance between stops 54 and 55 along the circular member 51 and could be changed to meet any desired limits.

DESCRIPTION OF THE SECOND EMBODIMENT

Figure 6:
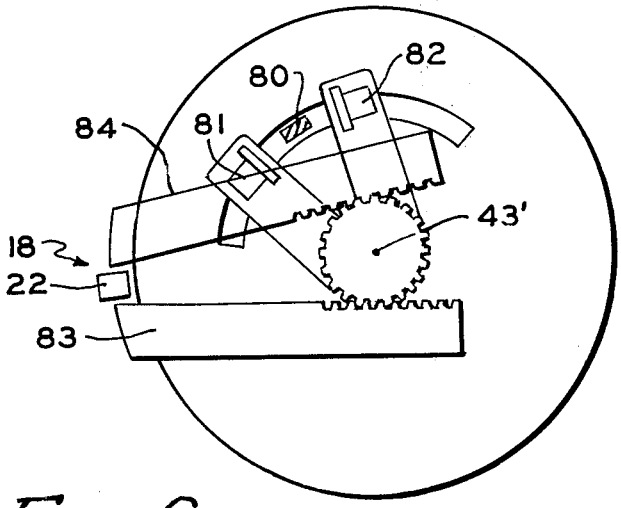
FIG. 6 is a second embodiment of the present invention.

Referring to FIG. 6, a second embodiment of the present invention is shown wherein a member 80 is attached to the temperature control point adjusting knob or shaft such as knob 23 and shaft 43 of FIG. 2. Member 80 is limited by the position of stops 81 and 82 which can be adjusted by position of member 83 and 84 to allow operation of a heating or cooling lever 22. Member 83 or 84 is held in a certain position by the changeover switch lever 22' depending upon whether switch 22 is in the heating or cooling mode. The limiting action for the heating and cooling operation is determined by the adjustment of stops 81 and 82 and would be set for a predetermined design.

Depending upon whether the thermostat is in the heating or cooling operation as selected by the position of changeover member 83 and 84, stops 81 and 82 would be moved about shaft 43' to be in some fixed position depending upon whether heating or cooling operation was desired. Thus the position of movement of the control point adjusting knob attached to member 80 would be limited to provide for a maximum heating temperature operation and a minimum cooling operation.

The embodiments of the invention in which an exclusive property or right is claimed are defined as follows:

1. An improvement to a thermostat adapted for controlling either heating or cooling apparatus in response to a temperature responsive means connected to have its control point temperature selected by a single temperature selector member and having a first temperature range of operation for heating operation and a second temperature range of operation for cooling operation and a separate changeover means for selecting either heating or cooling operation, the improvement comprising, limit means for said single temperature selector, and means for connecting said changeover means to said limit means for selecting either said first range or said second range of operation.

2. In a thermostat adapted for controlling heating and cooling apparatus, comprising, a base member, temperature responsive switch means attached to said base member, temperature control point adjustment means mounted on said base member and connected to adjust the control point of said temperature responsive switch means, changeover means connected to said temperature responsive switch means adapted for selectively connecting either heating apparatus or cooling apparatus to said temperature responsive switch means, temperature control point limit means connected to said temperature control point adjustment means, and first means independent of said temperature control point adjustment means for selectively connecting said changeover means to said limit means to limit the range of movement of said control point adjustment means to a first range when heating is selected by said changeover means and to a second range when cooling is selected by said changeover means.

3. The invention of claim 2 wherein said temperature control point limit means comprises a member having a first slot extending for a length of said first range and a second slot extending for a length of second range, said first means comprises a first member selectively received in said first slot and a second member selectively received in said second slot, depending upon the selection of heating or cooling operation.

4. The invention of claim 2 wherein said changeover means comprises a lever attached to said base and movable to a first and second position for closing a first and second switch means, said limit means comprises a first slot extending through said first range and a second slot extending through said second range, and said first means comprises a first and second button member, said first button member is adapted to be received in said first slot when said temperature control point adjustment means is in said first range for heating operation and said second button member is adapted to be received in said second slot when said temperature control point adjustment means is in said second range for cooling operation.

5. The invention of claim 4 comprising projection means attached to said changeover lever associated with said first and second button members to prevent movement of said lever to said first or second position until one of said buttons is moved into its respective said slot whereby operation of either said heating or cooling operation is prevented until either a heating or cooling range is selected.

6. The invention of claim 1 comprising, a subbase member mounted below said base member, means connecting said changeover means to said subbase, means mounting said limit means between said subbase and said base, said means comprising a member between said base and subbase members having first and second slots, and button means mounted on said subbase having projections received for said slots to provide a first and second range of operation.

7. The invention of claim 6 wherein said changeover means has a lever with a projection cooperating with said button means to hold said button means in a limiting operation manner when said lever is moved to the position of either heating or cooling operation.

* * * * *